US011295873B2

(12) United States Patent
Oishi

(10) Patent No.: US 11,295,873 B2
(45) Date of Patent: Apr. 5, 2022

(54) COAXIAL CABLE

(71) Applicant: Nissei Electric Co., Ltd., Shizouka (JP)

(72) Inventor: Kyosuke Oishi, Shizuoka (JP)

(73) Assignee: NISSEI ELECTRIC CO., LTD, Shizouka (JP)

( * ) Notice: Subject to any disclaimer, the term of this patent is extended or adjusted under 35 U.S.C. 154(b) by 0 days.

(21) Appl. No.: 17/252,543

(22) PCT Filed: Jun. 18, 2019

(86) PCT No.: PCT/JP2019/024046
§ 371 (c)(1),
(2) Date: Dec. 15, 2020

(87) PCT Pub. No.: WO2020/004132
PCT Pub. Date: Jan. 2, 2020

(65) Prior Publication Data

US 2021/0327610 A1 Oct. 21, 2021

(30) Foreign Application Priority Data

Jun. 25, 2018 (JP) ..... JP2018-119743

(51) Int. Cl.
*H01B 7/22* (2006.01)
*H01B 11/18* (2006.01)
*H01B 7/18* (2006.01)

(52) U.S. Cl.
CPC ..... *H01B 7/226* (2013.01); *H01B 11/18* (2013.01)

(58) Field of Classification Search
CPC .. H01B 7/226; H01B 11/183; H01B 11/1826; H01B 11/1813; H01B 11/1808; H01B 11/18
See application file for complete search history.

(56) References Cited

U.S. PATENT DOCUMENTS 4,694,122 A * 9/1987 Visser ..... H01B 13/26 156/53
5,293,001 A * 3/1994 Gebs ..... H01B 11/1808 174/102 R
2006/0054334 A1* 3/2006 Vaupotic ..... H01B 11/1008 174/36
2015/0008011 A1* 1/2015 Koeppendoerfer .... H01B 11/02 174/113 R
2020/0312486 A1* 10/2020 Rousselet ..... H01B 7/22

FOREIGN PATENT DOCUMENTS

JP 55-131017 U 9/1980
JP 06203664 A * 7/1994
JP 6203664 A 7/1994
JP 2005327641 A 11/2005
JP 2011058915 A 3/2011
JP 2015-18669 A 1/2015
JP 2015018669 A * 1/2015
JP 2017-214501 A 12/2017

* cited by examiner

*Primary Examiner* — Hoa C Nguyen
*Assistant Examiner* — Amol H Patel
(74) *Attorney, Agent, or Firm* — Hayes Soloway P.C.

(57) ABSTRACT

A coaxial cable according to the present disclosure is characterized by including a metal layer (5), inside an outer conductor (8), being bonded to the outer conductor (8) by means of an adhesive (6) in such a manner that the metal layer (5) is in contact with a part of the outer conductor (8).

16 Claims, 4 Drawing Sheets

COAXIAL CABLE

CROSS-REFERENCE TO RELATED APPLICATIONS AND PRIORITY

This patent application claims priority from PCT Patent Application No. PCT/JP2019/024046 filed Jun. 18, 2019, which claims priority from Japanese Patent Application No. 2018-119743 filed Jun. 25, 2018. Each of these patent applications are herein incorporated by reference in its/their entirety.

TECHNICAL FIELD

The present disclosure relates to a coaxial cable used as a signal transmission line for high-frequency components of an information communication device, a communication terminal device, even a measuring instrument, and the like and as a device wiring line for medical instruments including an endoscope, an ultrasonic diagnostic apparatus, and the like.

BACKGROUND ART

In recent years, an information communication device, a communication terminal device, and the like shrink in size and have smaller wiring space inside, and further thinning of a coaxial cable is required. Meanwhile, even in a thin wire, improvement of a high-frequency property such as attenuation is desired for a faster and larger-volume information communication device.

As a structure aiming at improvement of the high-frequency property of the coaxial cable, for example, a structure is known in which a metal-foil PET laminated tape is longitudinally attached to an outer circumference of a dielectric and a plurality of annealed copper wires is braided thereon as an outer conductor (Patent Literature 1). However, when an outer conductor has a braided structure as in Patent Literature 1, the braided structure is thick in comparison with a horizontal winding structure, and thus is disadvantageous to thinning.

In a case of the horizontal winding structure in which a plurality of wire rods is helically wound as an outer conductor, the horizontal winding structure is preferable for thinning of a coaxial cable, but there is a concern that disarrangement, floating, and loosening of the outer conductor may occur upon bending of the coaxial cable or upon terminal treatment. In order to solve the problem, a structure is known in which an adhesive layer is provided around the outer circumference of a dielectric and an outer conductor is provided around the outer circumference of the adhesive layer (for example, Patent Literature 2). FIG. 4 in Patent Literature 2 illustrates a view of an adhesive tape horizontally wound around the outer circumference of a dielectric. When an adhesive tape is horizontally wound, there is a concern that smoothness between a dielectric and an outer conductor may be lost and attenuation and return loss (VSWR) may increase.

Furthermore, a coaxial cable for high-frequency signal transmission in Patent Literature 3 includes: a conductor; an insulation layer formed around the conductor; a light shielding layer formed around the insulation layer; a shield layer formed in such a manner that an element wire is horizontally wound around the light shielding layer; and a covering layer formed around the shield layer, in which the shield layer is adhesively fixed to the light shielding layer, and the light shielding layer is merely for preventing damage of an inner conductor caused by laser light upon terminal treatment.

CITATION LIST

Patent Literature

Patent Literature 1: Unexamined Japanese Patent Application Publication No. 2005-327641

Patent Literature 2: Unexamined Japanese Patent Application Publication No. 2011-058915

Patent Literature 3: Unexamined Japanese Patent Application Publication No. 2015-018669

SUMMARY OF INVENTION

Technical Problem

However, a conventional coaxial cable is unable to comprehensively solve problems including a measure against deterioration of electrical properties such as attenuation and return loss in association with thinning, and disarrangement and the like of an outer conductor during terminal treatment.

The present disclosure has been made in view of such circumstances, and provides a coaxial cable that has improved electrical properties, undergoes less change in the electrical properties before and after twisting, is capable of being thinned, and is capable of preventing disarrangement and the like of an outer conductor.

Solution to Problem

A coaxial cable according to claim 1 is characterized by including a metal layer, inside an outer conductor, being bonded to the outer conductor by means of an adhesive in such a manner that the metal layer is in contact with a part of the outer conductor.

A coaxial cable according to claim 2 is characterized by including a tape material, inside an outer conductor, being formed of a metal layer and an adhesive integrated into a tape shape, and is characterized in that the metal layer is bonded to the outer conductor by means of the adhesive in such a manner that the metal layer is in contact with a part of the outer conductor.

A coaxial cable according to claim 3 is characterized in that a tape material is formed in an order of a resin layer, a metal layer, and an adhesive, and in that the resin layer is located between a dielectric and the metal layer.

A coaxial cable according to claim 4 is characterized in that a thickness of a metal layer is 1 μm or more and 20 μm or less.

A coaxial cable according to claim 5 is characterized in that a sheath is arranged around the outermost circumference outside an outer conductor, and in that an outermost diameter outside the sheath is 1.4 mm or less.

A coaxial cable according to claim 6 is characterized in that a metal layer is bonded to an outer conductor by means of an adhesive helically provided over an outer circumference surface of the metal layer along a wire direction.

A coaxial cable according to claim 7 is characterized in that a tape material is arranged in such a manner as to be longitudinally attached along a wire direction.

A coaxial cable according to claim 8 is characterized in that an outer conductor has a structure in which a conducting material including a plurality of conducting wires is horizontally wound.

A coaxial cable according to claim 9 is characterized in that the coaxial cable is formed in such a manner as to have a usable frequency of DC to 110 GHz.

A coaxial cable according to claim 10 is characterized in that the coaxial cable is formed in such a manner that amount of change in characteristic impedance before and after 180-degree twisting is 1.0 Ω or less.

Advantageous Effects of Invention

The present disclosure includes a metal layer, inside an outer conductor, being bonded to the outer conductor by means of an adhesive in such a manner that the metal layer is in contact with a part of the outer conductor. Thus, the present disclosure has improved electrical properties, undergoes less change in the electrical properties before and after twisting, is capable of being thinned, and is capable of preventing disarrangement and the like of the outer conductor.

DESCRIPTION OF EMBODIMENTS

Figure 1:
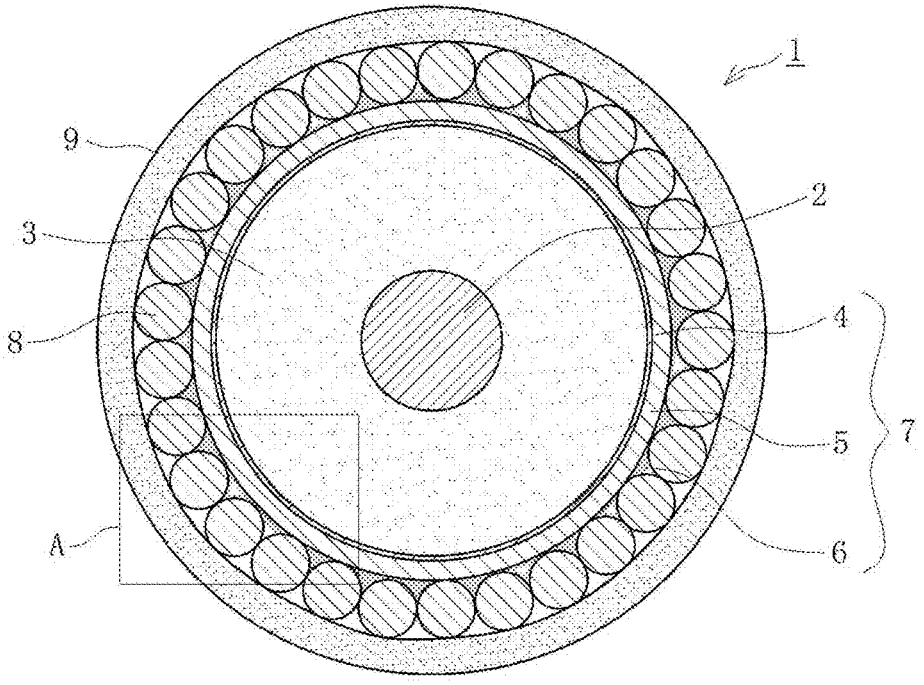
FIG. 1 is an explanatory diagram illustrating one example of a cross-section of a coaxial cable according to the present disclosure.
Figure 2:
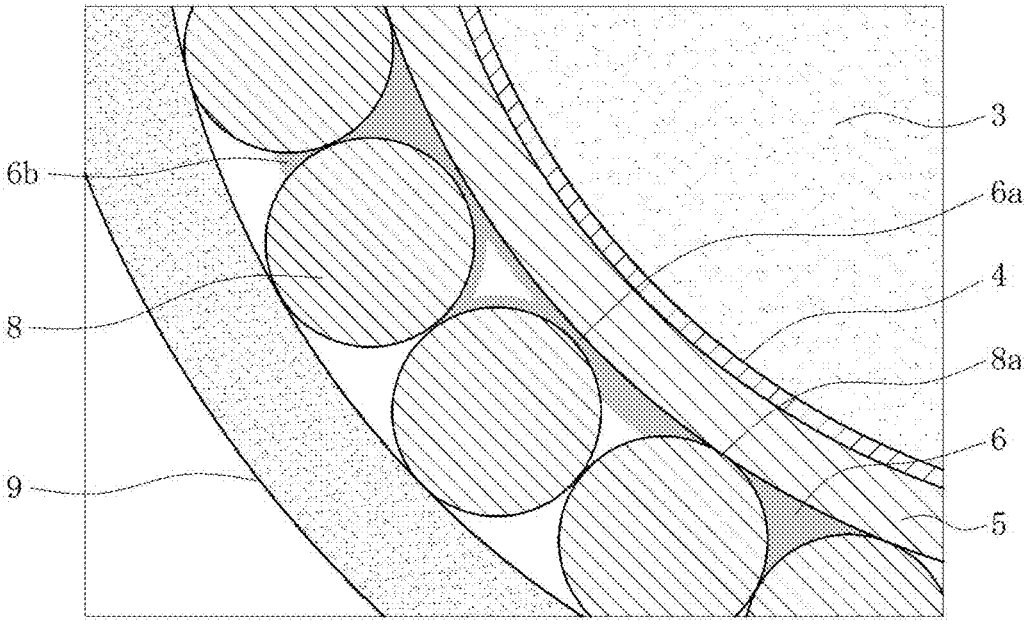
FIG. 2 is an explanatory diagram illustrating enlarged part A of the cross-section in FIG. 1.
Figure 3:
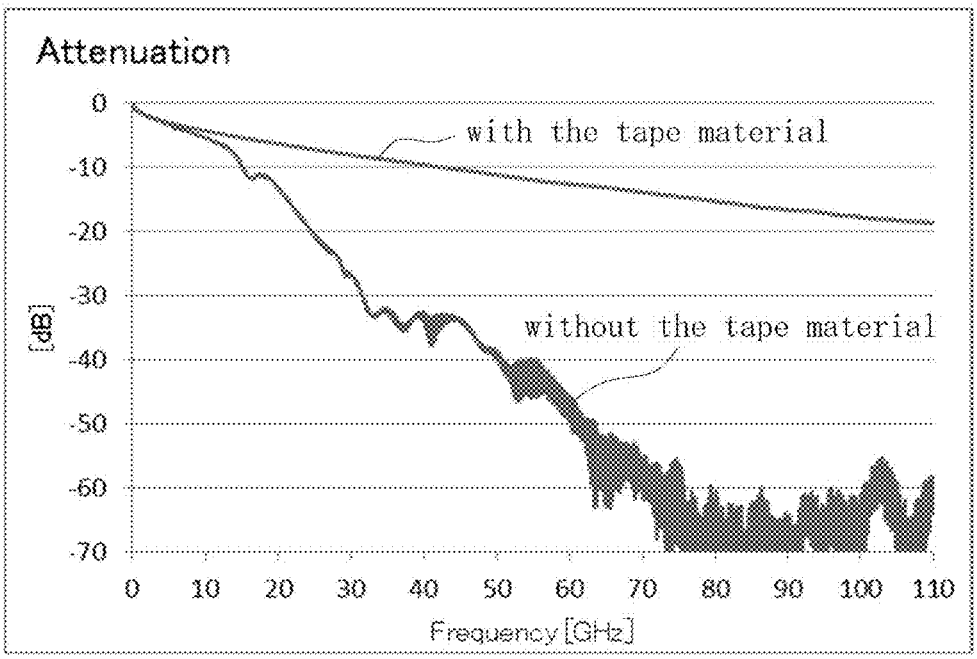
FIG. 3 is an explanatory diagram illustrating attenuation of the coaxial cable according to the present disclosure.

A basic configuration will be described hereinafter with reference to the drawings, as one example of a coaxial cable according to the present disclosure. FIG. 1 is an explanatory diagram illustrating one example of a cross-section of the coaxial cable according to the present disclosure. FIG. 2 is an explanatory diagram illustrating enlarged part A of the cross-section in FIG. 1. FIG. 3 is an explanatory diagram illustrating attenuation of the coaxial cable according to the present disclosure. FIG. 4 is an explanatory diagram illustrating change in characteristic impedance before and after twisting of the coaxial cable according to the present disclosure. FIG. 5 is an explanatory diagram illustrating one example of arrangement of an adhesive in the coaxial cable according to the present disclosure.

Coaxial cables 1 and 10 illustrated in figures include an inner conductor 2 arranged at the center thereof, and include a dielectric 3, a resin layer 4, a metal layer 5, and an outer conductor 8 sequentially arranged around an outer circumference of the inner conductor 2. Note that, the resin layer 4 is optional, as will be described later. Further, in FIGS. 1 and 2, the coaxial cable 1 includes a sheath 9 provided at the outermost side thereof. However, some coaxial cables include a sheath arranged therein while other coaxial cables include no sheath arranged therein, and any cases may be used (a case in which the sheath 9 is included will be described explicitly.).

A characteristic structure of the coaxial cables 1 and 10 according to the present disclosure is that the coaxial cables 1 and 10 include the metal layer 5, inside the outer conductor 8, being bonded to the outer conductor 8 by means of an adhesive 6 in such a manner that the metal layer 5 is in contact with a part of the outer conductor 8. Note that, the inner conductor 2, the dielectric 3, the outer conductor 8, and the sheath 9 being basic elements as an electrical wire of the coaxial cables 1 and 10 are not particularly limited, but will be described in detail together with the metal layer 5 and the adhesive 6.

First, a material of the inner conductor 2 is not particularly limited to as long as the material has electrical conductivity, but, for example, a metal wire such as copper, silver, and aluminum, an alloy wire thereof with the addition of tin, iron, zinc, silver, nickel, and the like, and the like are used as an element wire. Plating such as silver plating and tin plating may be applied to a surface of the metal wire. Further, a configuration of the inner conductor 2 is preferably, but not particularly limited to, a stranded wire structure formed by twisting a plurality of bundled metal wires, in consideration of flexibility against bending, thinning of the coaxial cable 1, and the like.

Further, an outer diameter of the inner conductor 2 is preferably, but not particularly limited to, American wire gauge (AWG) 28 or more, more preferably AWG 36 or more, and most preferably AWG 40 or more, in consideration of thinning and the like of the coaxial cables 1 and 10.

A material of the dielectric 3 is not particularly limited as long as the material has an electrical insulation property, but, for example, examples of the material include a thermoplastic resin such as a fluororesin and a polyolefin, a silicone rubber, a fluororubber, a polyvinyl chloride (PVC), and a polyurethane. As the material of the dielectric 3, preferably, the thermoplastic resin such as the fluororesin and the polyolefin may be used, and the thermoplastic resin such as the polyolefin is excellent in flexibility, an extrusion property, and the like. The fluororesin as the material of the dielectric 3 has low permittivity, high volume resistivity, and a high insulation property in comparison with others, and thus is suitable for thinning of the coaxial cables 1 and 10.

The resin layer 4 is preferably, but optionally, included when a tape-shaped configuration to be described later is employed. In a process of applying a tape material 7, even when tension is applied to the tape material 7, the resin layer 4 appropriately stretches, and thus can prevent the tape material 7 from breaking. A material of the resin layer 4 is not particularly limited. Examples of the material include, for example, a polyethylene terephthalate (PET), a polyethylene, a polyurethane, a fluororesin, and the like. The PET is preferable, in consideration of flexibility, processability, and the like.

A material of the metal layer 5 is not particularly limited as long as the material has electrical conductivity, but, for example, examples of the metal layer 5 include copper, aluminum, lead, tin, silver, gold, and the like, and copper is preferable, in consideration of a shield property, price, and the like. A thickness of the metal layer 5 is not particularly limited to, but 1 μm or more and 20 μm or less.

The adhesive 6 is for bonding the metal layer 5 to the outer conductor 8, and a material of the adhesive 6 is not particularly limited. Examples of the material of the adhesive 6 include, for example, polyester-based, acrylic-based, olefin-based, urethane-based, silicone-based, and the like materials, and, particularly, polyester-based, olefin-based, urethane-based, and the like materials that do not generate any impurity such as a siloxane are preferable. When the adhesive 6 is a polyester-based adhesive, adhesiveness and durability between the metal layer 5 and the outer conductor 8 are improved. Furthermore, the adhesive 6 may have electrical conductivity. Examples include a method of using a conductive adhesive for the adhesive 6, a method of mixing a conductive filler with the adhesive 6, and the like.

A melting point of the adhesive 6 is preferably, but not particularly limited to, 60 to 150 degrees, where curing of the adhesive 6 does not proceed at room temperature and the adhesive 6 can be melted in a relatively simple facility. The melting point of the adhesive 6 is more preferably 80 to 100 degrees, and examples of the adhesive 6 include, for example, a hot melt adhesive. The hot melt adhesive is excellent in productivity because of a rapid cure rate in comparison with an elastic adhesive and the like.

Further, a permittivity and a dielectric loss tangent of the adhesive 6 is preferably, but not particularly limited to, 4.0 or less and 0.1 or less, respectively, in terms of a high-frequency property.

A material of the outer conductor 8 is not particularly limited to as long as the material has electrical conductivity, but, for example, a metal wire such as copper and aluminum, or an alloy wire thereof with the addition of tin, iron, zinc, silver, nickel, and the like, and the like are used as an element wire. Plating such as silver plating and tin plating may be applied to the surface of the metal wire constituting the outer conductor 8.

A structure of the outer conductor 8 is preferably a structure in which a conducting material including a plurality of conducting wires is horizontally wound. The outer conductor 8 is advantageous to thinning of the coaxial cables 1 and 10, in comparison with a case of a braided structure. Since the metal layer 5 is bonded to the outer conductor 8 by means of the adhesive 6 in the coaxial cables 1 and 10, disarrangement and floating of the outer conductor 8 can be prevented upon bending of the coaxial cables 1 and 10, even when the outer conductor 8 has a horizontal winding structure.

Note that, an angle of horizontal winding of the outer conductor 8 is preferably 5 to 45 degrees, and particularly more preferably 5 to 25 degrees, relative to a wire direction of the coaxial cables 1 and 10.

Furthermore, an element wire diameter of the outer conductor 8 is preferably, but not particularly limited to, 0.3 mm or less, and more preferably 0.1 mm or less, in consideration of thinning of the coaxial cables 1 and 10. Further, the number of the outer conductors 8 is not particularly limited, but is determined as appropriate according to the element wire diameter of the outer conductor 8, the outer diameter of a cable in the process of manufacture upon application of the outer conductor 8, and the like.

A material of the sheath 9 is not particularly limited, but, for example, examples of the material include a fluororesin, a polyvinyl chloride, a polyurethane, a polyethylene, a polyamide resin, a polyimide resin, a polyester-based elastomer, and the like.

Next, a state of bonding between the outer conductor 8 and the metal layer 5 will be described based on FIG. 1 illustrating a cross-section of the coaxial cable 1 and FIG. 2 illustrating an enlarged part A of the cross-section in FIG. 1. First, the outer conductor 8 and the metal layer 5 are bonded to each other in such a manner that the metal layer 5 inside the outer conductor 8 is in contact with a part of the outer conductor 8. Herein, an entire surface of the metal layer 5 is not necessarily in contact with the outer conductor 8 in a closely adhered state, and the outer conductor 8 and the metal layer 5 only need to be in contact with each other to such a degree that electrical communication is established therebetween.

Specifically, as illustrated in FIG. 2, as long as the metal layer 5 is in contact with an outer conductor outer circumference part 8*a*, the metal layer 5 can be regarded as being bonded by means of the adhesive 6 in a partially contacting state. On the other hand, for example, at a part of an adhesive 6*a*, the adhesive 6*a* is present between the outer conductor 8 and the metal layer 5, and there is a part where the outer conductor 8 and the metal layer 5 are not in contact with each other. However, there may be a part where the outer conductor 8 and the metal layer 5 are not in contact with each other, as long as the outer conductor 8 and the metal layer 5 are in contact with each other at another part.

Furthermore, regarding how much amount of the adhesive 6 is arranged (filled) between the outer conductor 8 and the metal layer 5, the adhesive 6 is not necessarily filled completely, as some gaps are included in the adhesive 6 in FIG. 2, and a state where a part of the metal layer 5 is bonded to the outer conductor 8 by means of the adhesive 6 is merely needed. Furthermore, as illustrated by an adhesive 6*b* in FIG. 2, an adhesive sticking out to the sheath 9 side is no problem, as long as performance of the coaxial cable 1 is not deteriorated by the adhesive.

Next, improvement of productivity of the coaxial cables 1 and 10 according to the present disclosure and a case in which use is made of the tape material 7 having a tape-shaped structure that facilitates manufacture of a variety of bonding patterns will be described.

The tape material 7 is formed of the metal layer 5 and the adhesive 6 integrated into a tape shape. Note that, when use is made of the tape material 7, the tape material 7 is used in such a manner that the adhesive 6 comes on the outer conductor 8 side. The tape material 7 is supposed to include the adhesive 6 arranged in layers on the metal layer 5, and may have a structure in which the adhesive 6 is arranged over the entire surface of the metal layer 5, or may have a structure in which both of a portion having the adhesive 6 and a portion not having the adhesive 6 are present. Examples of a bonding pattern in which both of a portion having the adhesive 6 and a portion not having the adhesive 6 are present include, for example, stripes including vertical stripes, horizontal stripes, helical stripes, and the like, a check pattern, a dot pattern, and the like.

As illustrated in FIG. 5, an arrangement pattern of the adhesive 6, that is, the bonding pattern is preferably helical in which both of a portion having the adhesive 6 and a portion not having the adhesive 6 are alternately arranged, which is not a matter limited to the tape material 7. The adhesive 6 includes both of a portion having the adhesive 6 and a portion not having the adhesive 6 alternately in a wire direction of the coaxial cable 10, and thus disarrangement and floating of the outer conductor 8 can be easily prevented upon bending of the coaxial cable 10.

Note that, when the bonding pattern is helical, a clearance (pitch) between the adjacent adhesives 6 is more preferably, but not particularly limited to, 2 mm or less. Further, a width of the adhesive 6 in this case is more preferably, but not particularly limited to, 0.5 mm or more, in terms of more effective prevention of disarrangement and floating of the outer conductor.

The tape material 7, which optionally includes the resin layer 4, can also have such a structure in which the resin layer 4, the metal layer 5, and the adhesive 6 are formed in the order with the resin layer 4 located between the dielectric 3 and the metal layer 5. An advantageous effect of the resin layer 4 is as described above.

A thickness of the tape material 7 is preferably, but not particularly limited to, 50 μm or less. This is advantageous to thinning of the coaxial cables 1 and 10 and can minimize influence of the tape material 7 at a time of bending of the coaxial cables 1 and 10, and thus, flexibility against bending of the coaxial cables 1 and 10 can be kept. The thickness of the tape material 7 is more preferably 30 μm or less, which further contributes to thinning of the coaxial cables 1 and 10. Further, when an outermost diameter of the coaxial cable 1 including the sheath 9 is 1.2 mm or less, the thickness of the tape material 7 is more preferably 20 μm or less.

A thickness of the adhesive 6 in the tape material 7 before being applied to the coaxial cables 1 and 10 is preferably, but not particularly limited to, 0.5 μm or more and 10 μm or less, and even more preferably 1 μm or more and 5 μm or less, in consideration of enabling prevention of disarrangement and floating of the outer conductor 8 and preventing from influencing, by the adhesive 6, a high-frequency property such as attenuation.

A thickness of the resin layer 4 in the tape material 7 is preferably, but not particularly limited to, 1 μm or more and 10 μm or less, and even more preferably 1 μm or more and to 5 μm or less.

Further, a thickness of the metal layer 5 in the tape material 7 is preferably, but not particularly limited to, 1 μm or more and 20 μm or less, more preferably 1 to 10 μm, and most preferably 3 to 8 μm, regardless of whether the metal layer 5 has a tape shape. Reducing the thickness of the metal layer 5 is also advantageous to thinning of the coaxial cable, and flexibility against bending of the coaxial cable can be easily kept.

The most preferable combination in the tape material 7 is the resin layer 4 having a thickness of 1 μm or more and 10 μm or less, the metal layer 5 having a thickness of 5 μm or more and 20 μm or less, and the adhesive 6 having a thickness of 0.5 μm or more and 10 μm or less, in terms of enabling thinning of the coaxial cables 1 and 10 and ensuring tensile strength of the tape material 7.

Note that, in the tape material 7, a thickness ratio of the metal layer 5 to the adhesive 6 is preferably, but not particularly limited to, 2 to 10:1. The thickness ratio of the metal layer 5 to the adhesive 6 in the tape material 7 becomes 5 to 8:1, and thus a minimum required amount of the adhesive 6 is applied. Thus, the metal layer 5 and an outer conductor layer 8 in the tape material 7 are in good electrical communication, and thus, a transmission characteristic is improved.

Further, a width of the tape material 7 is preferably, but not particularly limited to, 1.5 times or less of the outer circumference of the dielectric 3, and even more preferably 1.2 times or less of the outer circumference of the dielectric 3, as a range where an overlap width of the tape material 7 is not too large and easiness and economic efficiency of manufacture can be improved. On the other hand, the width of the tape material 7 is preferably 0.8 times or more of the outer circumference of the dielectric 3, as a range where the outer circumference of the dielectric 3 can be wrapped, regardless of a form of the tape material 7.

Note that, the width of the resin layer 4 and the metal layer 5 in a tape 7 is preferably the same, but the width is not particularly limited. For example, the width of the resin layer 4 may be wider than the width of the metal layer 5.

The coaxial cables 1 and 10 having such a configuration include the metal layer 5, inside the outer conductor 8, being bonded to the outer conductor 8 by means of the adhesive 6 in such a manner that the metal layer 5 is in contact with a part of the outer conductor 8. Thus, the coaxial cables 1 and 10 having such a configuration have improved electrical properties, undergoes less change in the electrical properties before and after twisting, is capable of being thinned, and is capable of preventing disarrangement and the like of an outer conductor. More specifically, when the coaxial cables 1 and 10 are made thin, sufficient tension cannot be easily applied upon arrangement of the outer conductor 8, and thus, disarrangement and floating of the outer conductor 8 can easily occur upon bending of the coaxial cables 1 and 10. In the present disclosure, however, disarrangement and floating of the outer conductor 8 can be prevented because the metal layer 5 is bonded to the outer conductor 8.

Furthermore, the coaxial cables 1 and 10 include the metal layer 5, inside the outer conductor 8, being bonded to the outer conductor 8 by means of the adhesive 6 in such a manner that the metal layer 5 is in contact with a part of the outer conductor 8. Thus, loosening of the outer conductor 8 is prevented upon processing of the coaxial cables 1 and 10, and thus, processability of the coaxial cables 1 and 10 can be improved and return loss can be reduced upon connection of the coaxial cables 1 and 10 to a connector.

Further, since the metal layer 5 is included inside the outer conductor 8 of the coaxial cables 1 and 10 in such a manner that the metal layer 5 is in contact with a part of the outer conductor 8, the metal layer 5 acts as a shield member in the coaxial cables 1 and 10. This can improve a shield property of the coaxial cables 1 and 10 and enhance an effect of shielding electromagnetic noise.

Further, the coaxial cables 1 and 10 are preferably formed in such a manner that the sheath 9 is arranged around the outermost circumference outside the outer conductor 8, and an outermost diameter outside the sheath 9 is 1.4 mm or less, and particularly preferably 1.2 mm or less.

Further, since the coaxial cables 1 and 10 configured by the tape-shaped tape material 7 are characterized in that the adhesive 6 is integrated with the tape material and is preliminarily prepared, a process such as application of the adhesive 6 is unnecessary in a manufacture process of the coaxial cables 1 and 10 themselves. Furthermore, when the coaxial cables 1 and 10 include the sheath 9, the sheath 9 can be bonded to the outer conductor 8 by means of the adhesive 6 melted by heat applied during extrusion.

When pressurization is performed simultaneously with heating during extrusion of the sheath 9, the melted adhesive 6 penetrates between linear bodies of the outer conductor 8, and thus, adhesiveness between the tape material 7 and the outer conductor 8 is further improved. Further, when pressurization during extrusion of the sheath 9 is large, the adhesive 6 penetrates between linear bodies of the outer conductor 8. The metal layer 5 and the outer conductor 8 come in contact with each other in some parts with no adhesive 6 therebetween, and thus, electrical communication is established therebetween. The electrical communication causes the tape material 7 having the metal layer 5 to also act integrally with the outer conductor 8, which is more preferable since a shield property of the coaxial cables 1 and 10 can be improved and an effect of shielding electromagnetic noise can be enhanced.

A viscosity of the adhesive 6 is preferably, but not particularly limited to, 30 to 200 Pa·s. This can prevent the adhesive 6 from dripping from the tape material 7 before the adhesive 6 is completely cured, and can also prevent the adhesive 6 from unnecessarily adhering to the outer conductor 8 due to occurrence of "stringing" in the adhesive 6.

Furthermore, when the tape material 7 is arranged in such a manner as to be longitudinally attached along a wire direction of the coaxial cables 1 and 10, smoothness between the dielectric 3 and the outer conductor 8 is improved in comparison with horizontal winding, and thus, attenuation and return loss can be reduced. Further, the tape material 7 is arranged in such a manner as to be longitudinally attached along a wire direction of the coaxial cables 1 and 10, and thus thinning is facilitated.

Note that, the coaxial cables 1 and 10 can be formed in such a manner as to have a usable frequency of DC to 110 GHz, or can be formed in such a manner as to have amount of change in characteristic impedance before and after 180-degree twisting is 1.0 Ω or less, regardless of whether the coaxial cables 1 and 10 have a structure including the tape material 7.

EXAMPLES

The coaxial cable according to the present disclosure will be more specifically described hereinafter by using examples and comparative examples. However, the scope of the present disclosure is not limited thereto.

In a coaxial cable according to the examples and the comparative examples, an inner conductor is a stranded wire having an outer diameter of about 0.135 mm by twisting together seven element wires of silver-plated annealed copper wires each having an outer diameter of 0.045 mm, and a dielectric is a PFA resin having a thickness of 0.14 mm. A resin layer constituting a tape material is PET having a thickness of 4 μm, a metal layer is copper having a thickness of 8 μm, and an adhesive is a polyester-based hot melt adhesive. The tape material includes the resin layer, the metal layer, and the adhesive in order from inside in a radial direction of the coaxial cable. An arrangement pattern of the adhesive will be described later.

An outer conductor in the coaxial cable according to the examples and the comparative examples has a horizontal winding structure using forty-five element wires of silver-plated annealed copper wires each having an outer diameter of 0.03 mm, and has an angle of horizontal winding of 13.0 degrees relative to a wire direction of the coaxial cable. A sheath is a PFA resin having a thickness of 0.03 mm.

Example 1 will be described as "Examples 1-1 to 1-3" for different arrangement patterns of the adhesive. Example 1-1 is a helical arrangement pattern of the adhesive, and has a width of the adhesive and a clearance (pitch) between adjacent adhesives of about 0.5 mm in the wire direction of the coaxial cable. Example 1-2 is a helical arrangement pattern of the adhesive, and has a width of the adhesive and a clearance (pitch) between adjacent adhesives of about 2.0 mm in the wire direction of the coaxial cable. Example 1-3 has the adhesive over the entire outer circumference surface of the metal layer.

Comparative Example 1 is a structure having no adhesive. The coaxial cable has a structure in which the outer conductor is horizontally wound directly around the outer circumference surface of the metal layer.

Regarding Example 1 and Comparative Example 1, evaluation on loosening of the outer conductor is performed, and a result is indicated in Table 1.

(Method of Evaluation on Loosening of Outer Conductor)

First, 30 mm of the sheath is removed from an edge in a lengthwise direction of the coaxial cable to expose the outer conductor. When loosening of the outer conductor occurs at this stage, evaluation on loosening is defined as "Bad". Next, 20 mm of the exposed outer conductor is soaked in a solder bath at a temperature of about 250 degrees for two seconds, and loosening was evaluated according to the following criteria.

Very good: No occurrence of loosening

Good: Occurrence of loosening equal to or less than 1 time the outer diameter of the coaxial cable after removal of the sheath Bad: Occurrence of loosening more than 1 time the outer diameter of the coaxial cable after removal of the sheath

TABLE 1

| | Arrangement Pattern of Adhesive | Evaluation on Loosening of Outer Conductor |
|---|---|---|
| Example 1-1 | Helical Width and Pitch: about 0.5 mm | Very good |
| Example 1-2 | Helical Width and Pitch: about 2.0 mm | Good |
| Example 1-3 | Entire surface | Very good |
| Comparative Example 1 | None | Bad |

According to Table 1, in all Examples 1-1 to 1-3, disarrangement and floating of the outer conductor can be prevented in comparison with Comparative Example 1. This is because of the presence of the adhesive at least at a part between the metal layer and the outer conductor. In Examples 1-1 and 1-3, disarrangement and floating of the outer conductor can be prevented more effectively in comparison with Example 1-2. This indicates that, when the arrangement pattern of the adhesive is helical, the pitch needs to be a certain value or less in order to more effectively prevent disarrangement and floating of the outer conductor.

Further, FIG. 3 is a graph illustrating a result of comparing attenuation between Example 1-3 and Comparative Example 2. Herein, Example 1 is the above-described coaxial cable, and Comparative Example 2 has no tape material while having the same basic structure of the coaxial cable as Comparative Example 1.

(Attenuation Evaluation Method)

Attenuation within a range of 300 kHz to 110 GHz was measured for 1000 mm in length of the coaxial cable by using a network analyzer (N5230A manufactured by Keysight Technologies).

As can be seen from the graph in FIG. 3, there is a large difference in attenuation between a case with the tape material and a case without the tape material, and the presence of the tape material can reduce attenuation. Note that, a frequency band in which the coaxial cable according to the present disclosure is used is not particularly limited. However, as is apparent from the graph in FIG. 3, the coaxial cable according to the present disclosure is usable in a wide band from DC to 110 GHz. In particular, in consideration of attenuation, the coaxial cable according to the present disclosure is suitable for use in 100 MHz to 110 GHz, more preferably 3 to 110 GHz, and most preferably a high-frequency band from 30 to 110 GHz.

Further, FIG. 4 is a graph illustrating change in characteristic impedance before and after application of 180-degree twisting to the coaxial cable according to specifications of Example 1-3 and Comparative Example 1.

(Method of Measuring Amount of Change in Characteristic Impedance)

Length: 150 mm (with connectors at opposite ends)

Measuring machine: Network analyzer (N5230A manufactured by Keysight Technologies)

A difference between a resistance value in a normal (linear) state and a resistance value (characteristic impedance) in a 180° twisted state is defined as amount of change.

Figure 4A:
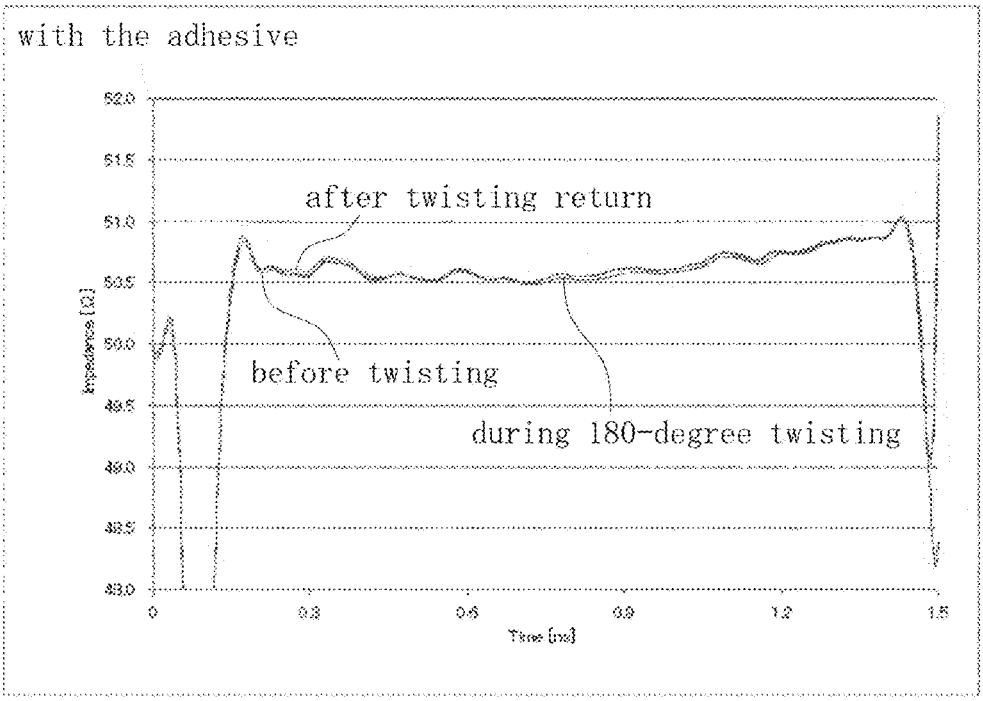
FIG. 4 is an explanatory diagram illustrating change in characteristic impedance before and after twisting of the coaxial cable according to the present disclosure.
Figure 4B:
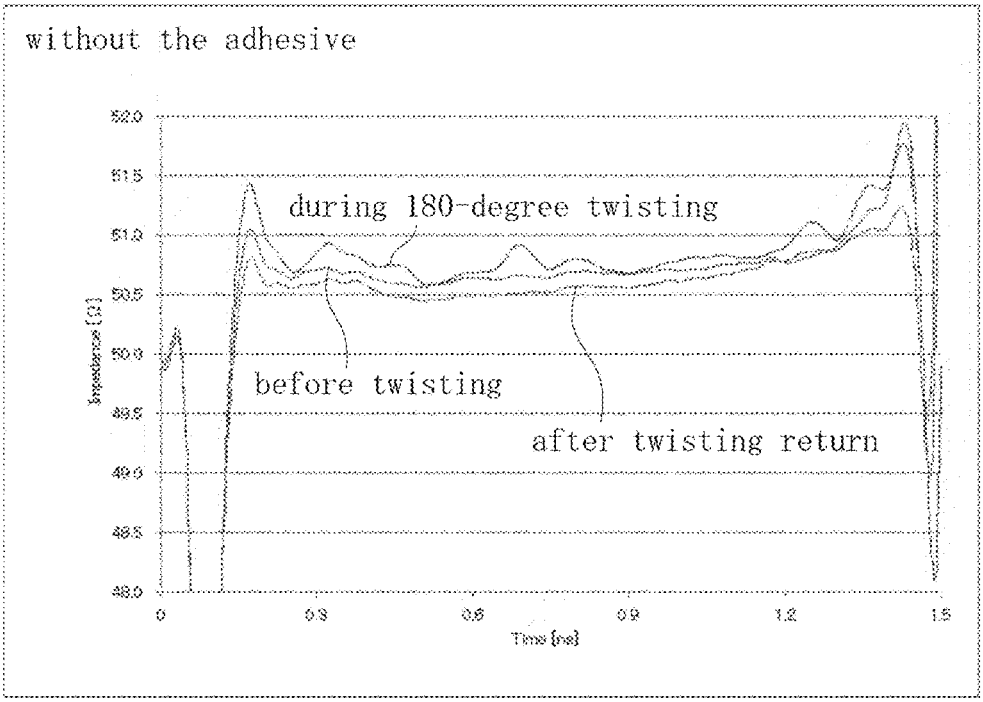
Figure 5:
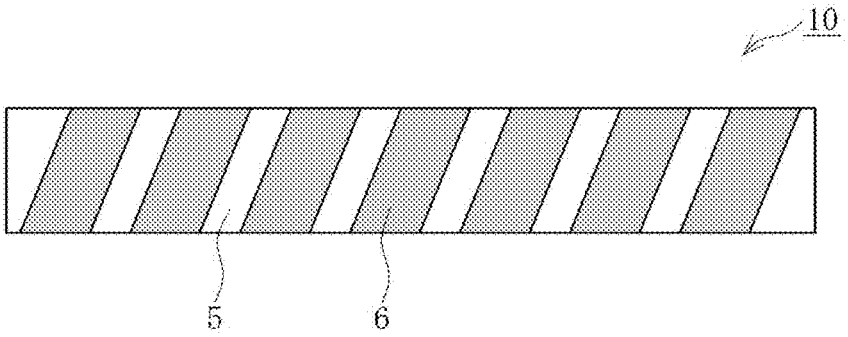
FIG. 5 is an explanatory diagram illustrating one example of arrangement of an adhesive in the coaxial cable according to the present disclosure.

FIG. 4A illustrates characteristic impedance before twisting, during 180-degree twisting, and during twisting return of the coaxial cable bonded by the adhesive. The amount of change in characteristic impedance before and after 180-degree twisting is kept at 0.1 Ω or less. In contrast to this, in Comparative Example 1 without the adhesive, the amount of change in characteristic impedance results in exceeding 1 Ω in the worst case. In this manner, the coaxial cable according to the present disclosure is excellent in stability of a transmission characteristic against twisting. In particular, regarding stability of characteristic impedance, the coaxial cable according to the present disclosure can be configured in such a manner that the amount of change in characteristic impedance during 180° twisting is within 1.0 Ω compared with characteristic impedance before twisting, and can also be kept more preferably within 0.5 Ω.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2018-119743, filed on Jun. 25, 2018, the entire disclosure of which is incorporated by reference herein.

INDUSTRIAL APPLICABILITY

As described above, the present disclosure can provide a coaxial cable that has improved electrical properties, undergoes less change in the electrical properties before and after twisting, is capable of being thinned, and is capable of preventing disarrangement and the like of an outer conductor.

REFERENCE SIGNS LIST

1 Coaxial cable
2 Inner conductor
3 Dielectric
4 Resin layer
5 Metal layer
6 Adhesive
**6*a*** Adhesive
**6*b*** Adhesive
7 Tape material
8 Outer conductor
**8*a*** Outer conductor outer circumference part
9 Sheath
10 Coaxial cable

The invention claimed is:

1. A coaxial cable including at least a dielectric and an outer conductor sequentially arranged around an outer circumference of an inner conductor, the coaxial cable comprising:

a metal layer, inside the outer conductor, being bonded to the outer conductor by means of an adhesive in such a manner that the metal layer is in contact with a part of the outer conductor, wherein the metal layer is bonded to the outer conductor by means of the adhesive helically provided over an outer circumference surface of the metal layer along a wire direction.

2. The coaxial cable according to claim 1, wherein a thickness of the metal layer is 1 μm or more and 20 μm or less.

3. The coaxial cable according to claim 1, wherein a sheath is arranged around an outermost circumference outside the outer conductor, and an outermost diameter outside the sheath is 1.4 mm or less.

4. The coaxial cable according to claim 1, wherein the outer conductor has a structure in which a conducting material including a plurality of conducting wires is horizontally wound.

5. The coaxial cable according to claim 1, wherein the coaxial cable is formed in such a manner as to have a usable frequency of DC to 110 GHz.

6. A coaxial cable including at least a dielectric and an outer conductor sequentially arranged around an outer circumference of an inner conductor, the coaxial cable comprising:

a metal layer, inside the outer conductor, being bonded to the outer conductor by means of an adhesive in such a manner that the metal layer is in contact with a part of the outer conductor, wherein the coaxial cable is formed in such a manner that amount of change in characteristic impedance before and after 180-degree twisting is 1.0 Ω or less.

7. The coaxial cable according to claim 6, wherein a thickness of the metal layer is 1 μm or more and 20 μm or less.

8. The coaxial cable according to claim 6, wherein a sheath is arranged around an outermost circumference outside the outer conductor, and an outermost diameter outside the sheath is 1.4 mm or less.

9. The coaxial cable according to claim 6, wherein the outer conductor has a structure in which a conducting material including a plurality of conducting wires is horizontally wound.

10. The coaxial cable according to claim 6, wherein the coaxial cable is formed in such a manner as to have a usable frequency of DC to 110 GHz.

11. A coaxial cable including at least a dielectric and an outer conductor sequentially arranged around an outer circumference of an inner conductor, the coaxial cable comprising:

a tape material, inside the outer conductor, being formed of a metal layer and an adhesive integrated into a tape shape, wherein the metal layer is bonded to the outer conductor by means of the adhesive in such a manner that the metal layer is in contact with a part of the outer conductor, and the coaxial cable is formed in such a manner that amount of change in characteristic impedance before and after 180-degree twisting is 1.0 Ω or less.

12. The coaxial cable according to claim 11, wherein a thickness of the metal layer is 1 μm or more and 20 μm or less.

13. The coaxial cable according to claim 11, wherein a sheath is arranged around an outermost circumference outside the outer conductor, and an outermost diameter outside the sheath is 1.4 mm or less.

14. The coaxial cable according to claim 11, wherein the tape material is arranged in such a manner as to be longitudinally attached along a wire direction.

15. The coaxial cable according to claim 11, wherein the outer conductor has a structure in which a conducting material including a plurality of conducting wires is horizontally wound.

16. The coaxial cable according to claim 11, wherein the coaxial cable is formed in such a manner as to have a usable frequency of DC to 110 GHz.

* * * * *